United States Patent [19]

Mori et al.

[11] Patent Number: 4,772,409

[45] Date of Patent: Sep. 20, 1988

[54] SILICONE-BASED WORKING FLUID FOR FLUID COUPLING

[75] Inventors: Shigeru Mori; Satoshi Kuwata; Kouji Sakuta, all of Gunma, Japan

[73] Assignee: Shin-Etsu Chemical Co., Ltd., Tokyo, Japan

[21] Appl. No.: 54,694

[22] Filed: May 27, 1987

[30] Foreign Application Priority Data

May 30, 1986 [JP] Japan ..... 61-125365

[51] Int. Cl.[4] ..... C10M 3/46

[52] U.S. Cl. ..... 252/78.3; 252/49.6; 556/413; 556/424; 556/425

[58] Field of Search ..... 252/49.6, 78.3; 556/413, 424, 425

[56] References Cited

U.S. PATENT DOCUMENTS

| | | | |
|---|---|---|---|
| 3,019,191 | 1/1962 | Furby et al. | 252/78.3 |
| 3,328,350 | 6/1967 | Omietanski et al. | 556/419 |
| 4,537,691 | 8/1985 | Mori et al. | 252/78.3 |
| 4,637,889 | 1/1987 | Kishimoto et al. | 252/78.3 |

*Primary Examiner*—Robert A. Wax

*Attorney, Agent, or Firm*—Millen & White

[57] ABSTRACT

A heat-resistant and oxidation-resistant working fluid for fluid coupling is provided by the invention in which 100 parts by weight of a methyl phenyl polysiloxane containing a relatively minor amount of phenyl groups in the molecules thereof is compounded with 0.01 to 5 parts by weight of an organopolysiloxane having at least one amino-substituted aromatic group, such as 4-(phenylamino)phenyl group, in a molecule thereof.

9 Claims, No Drawings

SILICONE-BASED WORKING FLUID FOR FLUID COUPLING

BACKGROUND OF THE INVENTION

The present invention relates to silicone-based compositions adapted to use as working fluids for fluid coupling, more particularly, to a silicone-based working fluid for fluid coupling having an extended durability in output performance with little viscosity decrease by thermal degradation, as a consequence of the excellent heat stability thereof in both hermetically sealed and open conditions.

Fluid compositions containing a dimethyl silicone oil as the principal component are widely used as a silicone-based working fluid for fluid coupling in various types of transportation machines because of the outstandingly small decrease in viscosity accompanying temperature elevation and excellent heat-resistance thereof as compared with other mineral oils or synthetic oils.

Even such a fluid composition, however, has a disadvantage of viscosity decrease resulting from the rearrangement of the molecular chains at high temperatures of, for example, 200° C. or above under influences of the internal friction in the oil during service, thereby causing a lowering of the output revolution from the fluid coupling. In addition, a gradual reaction by thermal oxidation of the dimethyl silicone oil by the oxygen in the coupling occurs on repeated use or for a long period of service, resulting in the phenomenon of viscosity increase eventually leading to gelation of the oil. The fluid coupling then falls into a condition of direct connection or seizure to give an output revolution exceeding the desired level, which sometimes leads to interruption of the revolution due to the overload. A great decrease in the revolution would be observed when the gelled structure is destroyed.

SUMMARY OF THE INVENTION

The present invention provides a silicone-based composition suitable for use as working fluid for fluid coupling which comprises:

(A) a methyl phenyl polysiloxane having a viscosity in the range from 100 to 1,000,000 centistokes at 25° C. represented by the average unit formula $$(CH_3)_a(C_6H_5)_bSiO_{(4-a-b)/2}, \quad (I)$$

in which the subscripts a and b are each a positive number satisfying the relationships that the sum a+b is in the range from about 1.95 to about 2.2 and the ratio b/(a+b) is in the range from about 0.05 to about 0.20; and (B) from about 0.01 to about 5 parts by weight, per 100 parts by weight of (A), of an amino-modified organopolysiloxane represented by the average chemical formula $$R^1O-[-SiR^2{}_2-O-]_n-R^1, \quad (II)$$

or $$R^2{}_3SiO-[-SiR^2{}_2-O-]_p-[-SiR^2(-OR^1-)-O-]_q-SiR^2{}_3, \quad (III)$$

in which $R^1$ is an amino-substituted aromatic group of one of the formulas: —Pn—NH—Ph; —Pn—NH—Pn—NH—Ph; —Pn—NH—(α—Np) and —Pn—NH—(β—Np), the symbol Ph being a phenyl group, Pn being a 1,4-phenylene group, (α—Np) being an α-naphthyl group and (β—Np) being a β-naphthyl group, $R^2$ is a monovalent aliphatic hydrocarbon group free from unsaturation or a phenyl group, the subscript n is a positive integer not exceeding 500 or, preferably, not exceeding 50, subscript p is zero or a positive integer not exceeding 47 and subscript q is a positive integer not exceeding 10, with the proviso that p+q does not exceed 48.

DETAILED DESCRIPTION OF THE PREFERRED EMBODIMENTS

The inventors have conducted extensive sutdies on silicone-based working fluids for fluid coupling free from the above described disadvantages in the conventional working fluids, which exhibit no or little viscosity decrease at high temperatures and are capable of operating the fluid coupling in a stationary condition for a long time. The present invention is based on a discovery that a working fluid for fluid coupling which is an organopolysiloxane composition comprising, as the principal component, a specific methyl phenyl polysiloxane admixed with a minor amount of an organopolysiloxane having a monovalent amino-modified aromatic group in the molecules thereof exhibits no marked decrease in the viscosity even by heating in a hermetically sealed condition at high temperatures of, for example, 200° C. or above and gives a substantial improvement in the heat-resistance in an open condition with an extended gelation time. Moreover, resistance of the working fluid against thermal oxidation is further improved by the addition of the amino-modified organopolysiloxane.

The methyl phenyl polysiloxane as the principal component of the silicone-based working fluid for fluid coupling of the invention is represented by the average unit formula (I) given above, in which the subscripts a and b are each a positive number satisfying the relationships that the sum a+b is in the range from 1.95 to 2.2 and the ratio b/(a+b) is in the range from 0.05 to 0.20. The methyl phenyl polysiloxane should have a viscosity in the range from 100 to 1,000,000, preferably from 500 to 100,000 and most preferably from 1000 to 20,000 centistokes at 25° C. When the value of the ratio b/(a+b), which gives the molar proportion of the phenyl groups to the overall organic groups contained in the molecules of the methyl phenyl polysiloxane, is smaller than 0.05, insufficient improvement in the heat-resistance required for the working fluid in a fluid coupling would be obtained. When the value of the ratio is larger than 0.20, on the other hand, the apparent viscosity decrease at high temperatures is remarkable due to the increase in the temperature dependency of the viscosity although the improvement in the heat-resistance is quite satisfactory to cause great decrease in the output revolution and output torque when the oil is used as a working fluid in a fluid coupling. Also, a methyl phenyl polysiloxane having a viscosity lower than 100 centistokes at 25° C. would give insufficient output torque while a viscosity higher than 1,000,000 centistokes at 25° C. indicates poor flowability of the fluid which renders it unsuitable as a working fluid in a fluid coupling.

The silicone-based composition of this invention, in addition to being useful as working fluids for fluid couplings, can also be used as a base oil for silicone greases which are particularly useful at high temperatures when it is processed with admixture of a conventional thickening agent and various types of additives conventionally used in silicone greases.

The compositions of this invention contain about 0.01 to about 5 parts, preferably about 0.05 to 1 part, by weight of an amino-modified organopolysiloxane represented by formula (II) or (III) given above, or a mixture thereof, as the component (B) per 100 parts by weight of the methyl phenyl polysiloxane employed as the component (A). The amino-modified organopolysiloxane as component (B) has at least one amino-modified aromatic group represented by one of the formulas:

—Pn—NH—Ph; —Pn—NH—Pn—NH—Ph;
—Pn—NH—(α—Np); and

—Pn—NH—(β—Np), in which the symbols Ph, Pn, (α—Np) and (β—Np) each denote a phenyl, 1,4-phenylene, α-naphthyl and β-naphthyl group, respectively, and $R^2$ in the formulas (II) and (III) is a monovalent aliphatic saturated hydrocarbon group, preferably of up to 20 carbon atoms, e.g., methyl, ethyl, propyl and butyl, cycloalkyl, e.g., cyclopentyl and cyclohexyl, or a phenyl group.

Such a mixture as a working fluid for fluid coupling has improved heat-resistance and reduced rate of viscosity increase as a consequence of thermal oxidation during use for a long period of service. In formula (II), subscript n, which indicates the average degree of polymerization of the organopolysiloxane, preferably does not exceed 50, e.g., is from 1 to 20. When the average degree of polymerization of the amino-modified organopolysiloxane of the formula (II) is too large, an unduly large amount of the amino-modified organopolysiloxane is required in order to give a full effect of upgrading the heat-resistance of the mixture, due to the decreased weight contribution of the amino-modified aromatic groups. Similarly, in formula (III), which represents another class of operable amino-modified organopolysiloxanes, the value of subscript p preferably does not exceed 47, e.g., is from 1 to 17, and a value of p+q does not exceed 48 because of the increase in the necessary amount of the amino-modified organopolysiloxane when subscript p exceeds 47 and p+q exceeds 48. Also, subscript q preferably has a value not exceeding 10 and more preferably is from 1 to 5, in view of the possible decrease in the compatibility of amino-modified organpolysiloxanes having a larger value for q with the methyl phenyl polysiloxane of formula (I), the principle component of the mixture. The methyl phenyl polysiloxane of the average unit formula (I) are well known products in the art of silicones.

The organopolysiloxanes having an amino-modified aromatic group as the component (B) which are employed can be obtained, for example, according to the disclosure in U.S. Pat. No. 3,328,350 by the condensation reaction of an aryl-substituted aminophenol corresponding to the amino-modified aromatic group in the organopolysiloxane such as 4-hydroxy-diphenylamine, N-phenyl-N'-(4-hydroxy)phenyl-1,4-phenylenediamine, 4-hydroxyphenyl 1-naphthyl amine, 4-hydroxyphenyl 2-naphthyl amine and the like with an organopolysiloxane having reactive groups such as acyl groups or halogen atoms.

The amount of the amino-modified organopolysiloxane employed as the component (B) in the inventive organopolysiloxane composition is in the range from about 0.01 to about 5 parts by weight per 100 parts by weight of the methyl phenyl polysiloxane as the component (A) since no satisfactory effect would be obtained by an amount smaller than about 0.01 part by weight and no additional advantageous effect ordinarily can be expected by the presence of the component (B) in an amount in excess of about 5 parts by weight. Other additives conventionally present in silicone-based working fluids, e.g., antioxidants, lubricity improvers and the like, may also be present in the compositions of this invention according to need.

Examples of the present invention are given in the following in which the term of "parts" always refers to "parts by weight" and the values of viscosity are all those obtained by measurement at 25° C.

The testing procedures for the evaluation of the working fluid in the Examples were as described below.

(Static heat-resistance test)

(1) Heat-resistance test under a hermetically sealed condition

A 30 g portion of the working fluid was taken in a glass ampoule of 50 ml capacity and the ampoule was sealed by welding. The ampoule was kept standing in a thermostatted hot-air circulation oven kept at 250° C. for 72 hours and the fluid taken out of the ampoule after cooling was subjected to the measurement of the viscosity.

(2) Heat-resistance test in an open condition

A 25 g portion of the working fluid was taken in a glass beaker of 100 ml capacity and kept standing in a thermostatted hot-air circulation oven kept at 250° C. for 120 hours and the fluid after cooling was subjected to the measurement of the viscosity.

(Durability test in a fan-coupling)

A 10 g portion of the working fluid was taken in a fan-coupling for compact cars and the fan-coupling was connected to a 7-blade fan having a diameter of 38 mm. A continuous driving test was undertaken using a fan-coupling tester machine at an input velocity of revolution of 7500 rpm for up to 240 hours.

TABLE 1

| | Working fluid | | | | | | |
|---|---|---|---|---|---|---|---|
| | (a) | (b) | (c) | (d) | (e) | (f) | (g) |
| Composition of fluid | | | | | | | |
| Content of phenyl groups in methyl phenyl polysiloxane, % | 10 | 15 | 5 | 20 | 10 | 15 | 0 |
| Amino modified dimethyl polysiloxane | | | | | | | |
| Type | A | A | B | B | C | D | A |
| Amount | 0.2 | 0.2 | 0.2 | 0.05 | 1.0 | 1.0 | 0.2 |
| Viscosity before test, cS | 3,520 | 3,280 | 3,300 | 3,580 | 3,550 | 3,250 | 3,420 |
| Results of tests | | | | | | | |
| Under hermetic sealing | | | | | | | |
| Viscosity after | 2,080 | 2,260 | 1,650 | 2,720 | 2,300 | 2,150 | 1,300 |

TABLE 1-continued

| | Working fluid | | | | | | |
|---|---|---|---|---|---|---|---|
| | (a) | (b) | (c) | (d) | (e) | (f) | (g) |
| test, cS | | | | | | | |
| Viscosity change, % | −41 | −31 | −50 | −24 | −35 | −34 | −62 |
| In open condition | | | | | | | |
| Viscosity after test, cS | 4,820 | 4,300 | 5,210 | 4,480 | 5,040 | 3,970 | gelled |
| Viscosity change, % | +37 | +31 | +58 | +25 | +42 | +22 | — |

EXAMPLES

Seven silicone-based working fluids for fluid coupling of this invention (a), (b), (c), (d), (e), (f) and a control (g) were prepared, each by adding one of the amino-modified organopolysiloxanes expressed by the chemical formula (A), (B), (C) or (D) given below, in which the symbol Me denotes a methyl group and Ph, Pn and (α—Np) each have the same meaning as defined before, in an amount shown in Table 1 to 100 parts of a methyl phenyl polysiloxane of the average unit formula (I) containing 5, 10, 15 or 20% by moles of phenyl groups relative to overall organic groups therein or a dimethyl polysiloxane having no phenyl groups for the working fluid (g) for comparative purpose:

(A) Ph—NH—Pn—O—$SiMe_2$—O—(—$SiMe_2$—O—)$_5$—$SiMe_2$—O—Pn—NH—Ph;

(B) Ph—NH—Pn—NH—Pn—O—$SiMe_2$—O—[—$SiMe_2$—O—]$_5$— —$SiMe_2$—O—Pn—NH—Pn—NH—Ph;

(C) $Me_3Si$—O—(—$SiMe_2$—O—)$_8$—[—SiMe{O—Pn—NH—(α—Np)}— —O—]$_2$—$SiMe_3$; and (D) $Me_3Si$—O—(—$SiMe_2$—O—)$_8$—[—SiMe(O—Pn—NH—Ph)—O—]$_2$—$SiMe_3$.

The results of the static heat-resistance tests for the seven working fluids (a) to (g) are shown in Table 1.

Furthermore, durability tests in a fan-coupling were carried out for the working fluids (a), (b) and (g) to give the results shown in Table 2.

TABLE 2

| | Working fluid | | |
|---|---|---|---|
| | (a) | (b) | (g) |
| Operating time, hours | 240 | 240 | 133 |
| Property of fluid after test | | | |
| Viscosity, centistokes | 3,270 | 3,210 | gelled |
| Change in viscosity, % | −7.1 | −2.1 | — |

What is claimed:

1. A silicone-based composition for fluid coupling which comprises:

(A) a methyl phenyl polysiloxane having a viscosity of from 100 to 1,000,000 centistokes at 25° C. and represented by the average unit formula $$(CH_3)_a(C_6H_5)_bSiO_{(4-a-b)/2},$$

in which the subscripts a and b are each a positive number satisfying the relationships that the sum a+b is in the range from 1.95. to 2.2 and the ratio b/(a+b) is in the range from 0.05 to 0.20; and (B) from 0.01 to 5 parts by weight, per 100 parts by weight of (A), of an amino-modified organopolysiloxane of the formula $$R^1O—[—SiR^2_2—O—]_n—R^1,$$

or $$R^2_3Si—O—[—SiR^2_2—O—]_p—[—SiR^2(—O—R^1—)—O—]_q—SiR^2_3,$$

in which $R^1$ is:

—Pn—NH—Ph; —Pn—NH—Pn—NH—Ph; —Pn—NH—(α—Np) or —Pn—NH—(β—Np), wherein Ph is phenyl, Pn is 1,4-phenylene, (α—Np) is α-naphthyl and (β—Np) is β-naphthyl, $R^2$ is a monovalent saturated aliphatic hydrocarbon group of up to 20 carbon atoms or phenyl, subscript n is a positive integer not exceeding 50, subscript p is zero or a positive integer not exceeding 47 and subscript q is a positive integer not exceeding 10, with the proviso that p+q does not exceeed 48.

2. The composition according to claim 1, which contains about 0.05 to about 1 part by weight of component (B) per 100 parts by weight of component (A).

3. The composition according to claim 1, wherein component (A) has a viscosity of from 500 to 100,000 centistokes at 25° C.

4. The composition according to claim 1, wherein component (B) is an amino-modified organopolysiloxane of the formula $$R^1O—[—SiR^2_2—O—]_n—R^1.$$

5. The composition according to claim 4, wherein n is a positive integer no greater than 20.

6. The composition according to claim 1, wherein component (B) is an amino-modified organopolysiloxane of the formula $$R^2_3Si—O—[—SiR^2_2—O—]_p—[—SiR^2(—O—R^1—)—O—]_q—SiR^2_3.$$

7. The composition according to claim 1, wherein p is from 1 to 17 and q is from 1 to 5.

8. The composition according to claim 1, wherein $R^2$ is methyl or phenyl.

9. The composition according to claim 1, wherein component (A) has a viscosity of from 500 to 100,000 centistokes at 25° C. and wherein component (B) is an amino-modified organopolysiloxane of the formula $$R^1O—[—SiR^2_2—O—]_n—R^1$$

in which $R^1$ is as defined therein, $R^2$ is methyl or phenyl, and n is a positive integer no greater than 20.

* * * * *